United States Patent [19]

Beck et al.

[11] Patent Number: 4,583,289

[45] Date of Patent: Apr. 22, 1986

[54] SYSTEM AND APPARATUS FOR TERMINATION OF FLAT CABLE

[75] Inventors: William R. Beck, Warren, N.J.; William Jahn, Iowa City, Iowa; Steven R. Koltenback, Doylestown, Pa.; Robert M. Scharf, Bedminster; Ronald Schwab, Budd Lake, both of N.J.

[73] Assignee: Thomas & Betts Corporation, Raritan, N.J.

[21] Appl. No.: 687,621

[22] Filed: Dec. 31, 1984

[51] Int. Cl.[4] ..... H01R 43/04

[52] U.S. Cl. ..... 29/749; 29/759; 29/861

[58] Field of Search ..... 29/749, 751, 753, 759, 29/861

[56] References Cited

U.S. PATENT DOCUMENTS

| | | | |
|---|---|---|---|
| 4,020,540 | 5/1977 | Casciotti et al. | 29/203 |
| 4,188,083 | 2/1980 | Knowles | 339/99 |
| 4,332,083 | 6/1982 | Johnson, Jr. et al. | 29/749 |
| 4,393,580 | 7/1983 | Hall, Jr. | 29/749 |
| 4,488,353 | 12/1984 | Caveney et al. | 29/749 |
| 4,489,589 | 12/1984 | Kirsinas et al. | 72/424 |
| 4,489,871 | 12/1984 | Bakermans et al. | 226/52 |

*Primary Examiner*—Carl E. Hall

*Attorney, Agent, or Firm*—Robert M. Rodrick; Salvatore J. Abbruzzese

[57] ABSTRACT

Termination of flat cable is effected with connectors fed individually from a reel having a wound substrate with connectors releasably secured thereto. The connectors are seated in a crimping device and elongate such cable is fed to the crimping device along the cable longtudinal axis. Cable guide and registration apparatus is also disclosed, as is a control system.

6 Claims, 15 Drawing Figures

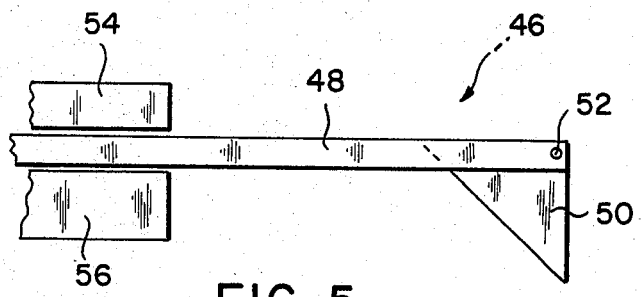
FIG. 5
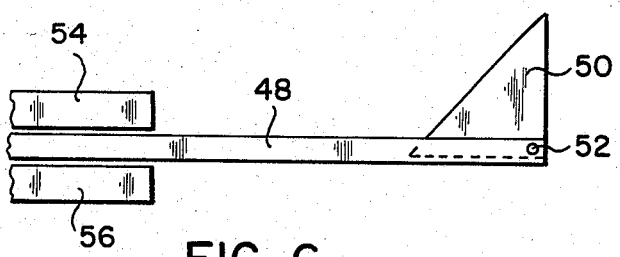
FIG. 6
FIG. 7
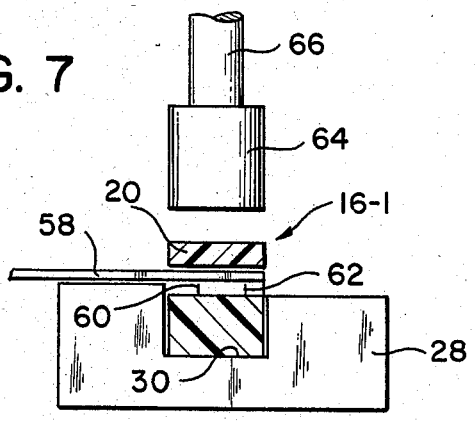

SYSTEM AND APPARATUS FOR TERMINATION OF FLAT CABLE

FIELD OF THE INVENTION

This invention relates generally to mass termination of flat multiconductor cable and pertains more particularly to method and apparatus for making assemblies of ribbon cable and insulation-displacing contact connectors (IDC connectors).

BACKGROUND OF THE INVENTION

Various apparatus has been made available heretofore for purchasers or suppliers of flat multiconductor cable and IDC connectors to make assemblies of same, for example, in portable tool version, such as is shown in U.S. Pat. No. 4,386,461, and in the form of a bench press, as in U.S. Pat. No. 4,020,540. In these devices, the IDC connector is placed in a lower die and the flat cable is placed in confronting relationship with the contacts. An upper die is then applied forcibly against the lower die, forcing the cable conductors independently into electrical engagement with the contacts.

In a recent commercial product, known as the "LATCON TM 0.050 Connector System" of Panduit, a reel-fed pneumatic termination press is provided wherein individual IDC connectors releasably secured to a web are fed from a reel into a press having a loading die to seat same. The particular IDC connectors usable in this system include a housing supporting the contacts and a cover overlying the contacts and supported at one end by a so-called living hinge. To insert a ribbon conductor in the seated connector, one lifts the cover pivotally about its hinge and advances the cable transversely into the connector, i.e., along an axis orthogonal to the cable longitudinal axis. With the cable so positioned, a die above the connector cover is activated to effect crimping and thus mass terminating the cable.

While the last-mentioned system adds a level of semi-automation as against the earlier two devices discussed above, it is limited in use to the IDC connectors of type having such pivotal cover. In that, many IDC connectors manufactured and sold are of type different than that for which the semi-automated system is adopted, substantial need exists for accommodating in automated, or semi-automated fashion the bulk of the connectors at hand.

SUMMARY OF THE INVENTION

This invention has as its primary object the provision of expedited manufacture of assemblies of ribbon cable and IDC connectors.

A more particular object of the invention is the provision of systems for termination of ribbon cable by the use of connectors of type having a cover latchingly supported at both ends to a connector housing and translatable for mass terminating the cable.

In its system and apparatus aspects, the invention introduces cable guide apparatus for effectively registering the ribbon cable and seated connector, and introduces a controller for coordination of the various steps at hand.

The invention will be further understood from the following detailed description of preferred embodiments thereof and from the drawings wherein like reference numerals identify like parts throughout.

DESCRIPTION OF THE DRAWINGS

FIGS. 5 and 6 are respective operable and inoperable states of a released connector pusher.

FIG. 7 is a front elevation of the FIG. 3 loading die with connector (sectioned), and cable in place.

DESCRIPTION OF PREFERRED EMBODIMENTS AND PRACTICES

Figures 1, 3:
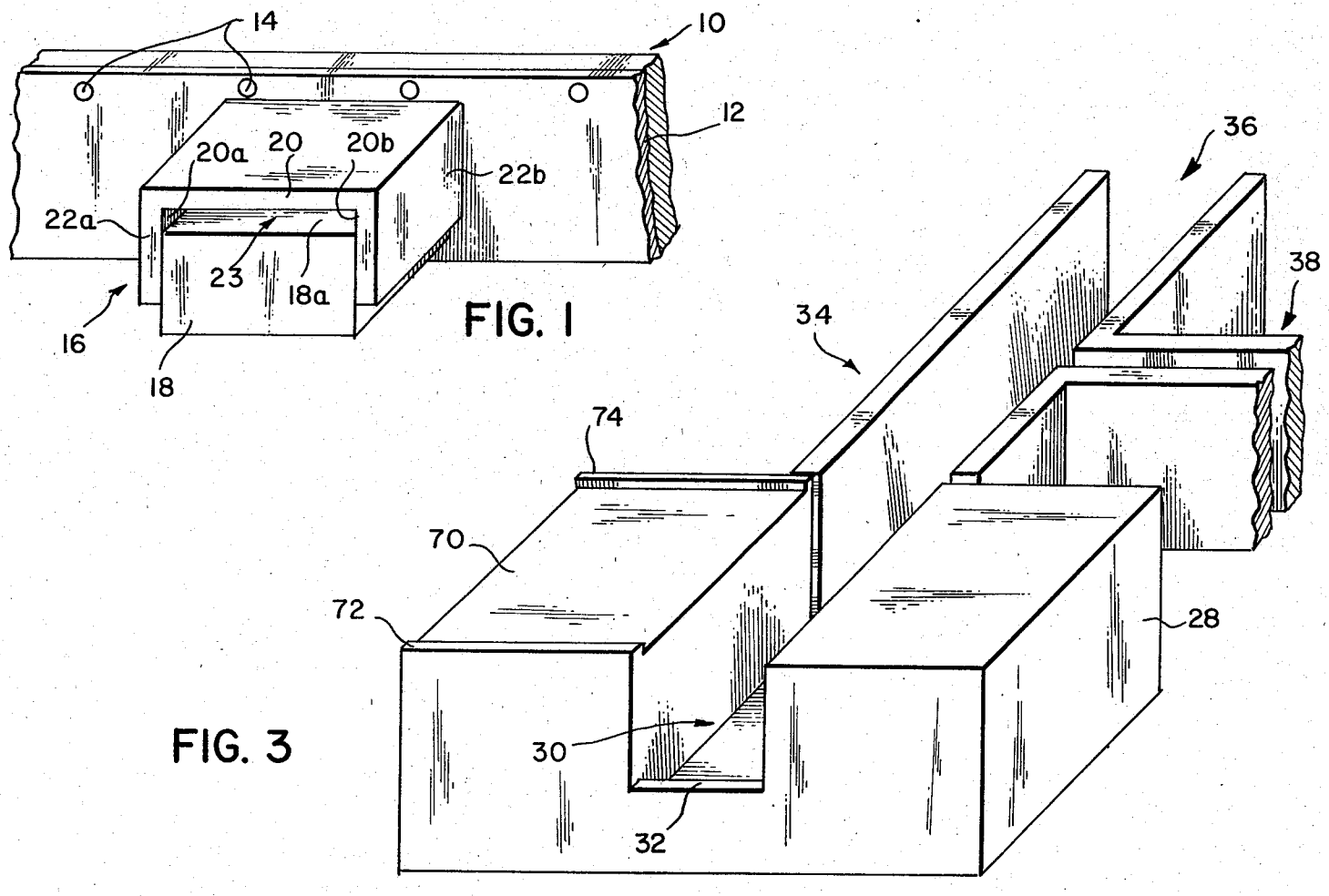
FIG. 1 is a perspective view showing an individual connector secured to a web.
FIG. 3 is a perspective view showing a loading die for connector seating and a portion of a connector chute and web egress guide.
Figure 2:
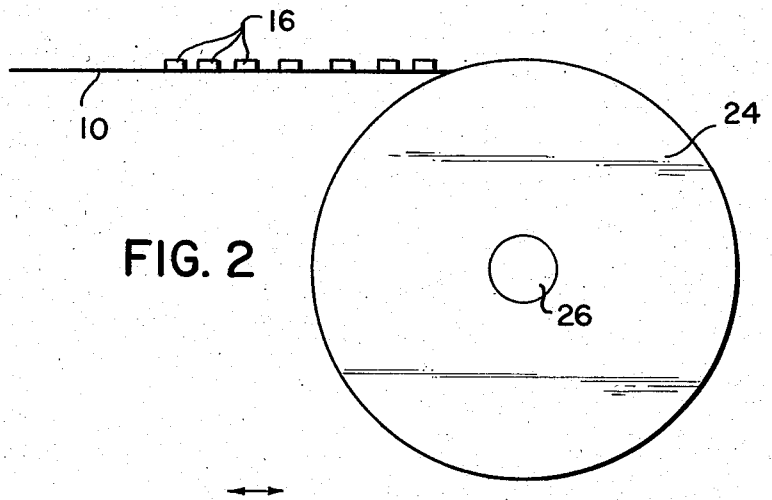
FIG. 2 is a plan view illustrating a reel upon which the web of FIG. 1 is wound and illustrating an end portion of the web in unreeled fashion.

Referring to FIG. 1, web or substrate 10 includes an adhesive layer 12 and has perforations 14 extending transversely therethrough at an upper margin. Connector 16 is mounted on web 10 and adhered thereto releasably by layer 12, the connector including base or housing 18 and cover 20, the cover having latch legs **22*a* and 22*b* extending downwardly in registry with cooperating latch structure on base 18. Opening 23 exists as between base 18 and cover 20 into which upwardly extend insulation-displacing contacts engageable with a ribbon cable (FIG. 7) entered into slot 23. As the connectors are disposed on the elongate substrate, the contacts are substantially parallel to the substrate longitudinal axis. In FIG. 2, web 10 is shown with a plurality of connectors 16 and is reeled upon reel 24 which is supported for rotation about shaft 26**.

Turning to FIG. 3, lower or loading die 28 defines a connection seat 30 leading to stop wall 32, which extends slightly above the floor of seat 30. Die 28 is supported fixedly with connector chute 34, the latter including a channel 36, which defines a predetermined path for connector movement. A web egress guide 38 extends laterally from chute 34.

Figure 4:
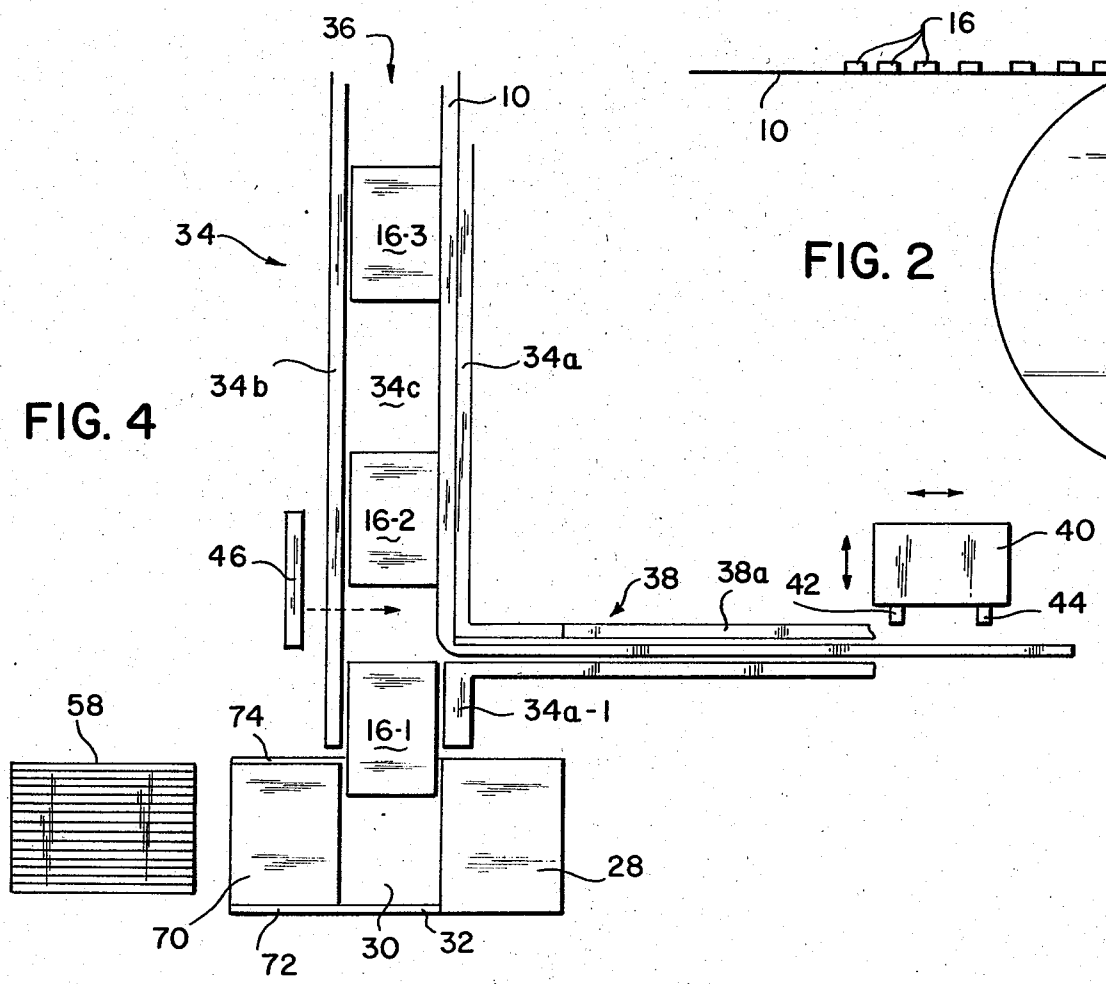
FIG. 4 is a plan view incorporating the FIG. 1 web and the FIG. 3 loading die.
Figure 10:
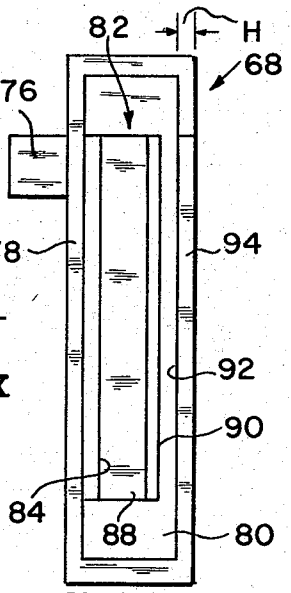
FIGS. 8–11 respective plan, front (along section plane IX—IX of FIG. 8), right end and left end views of a cable guide and registration device.
Figure 8:
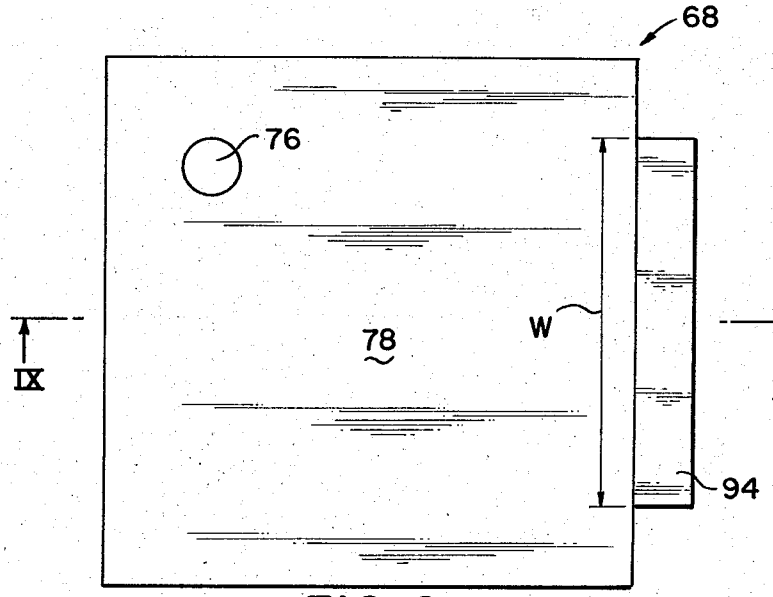
Figure 11:
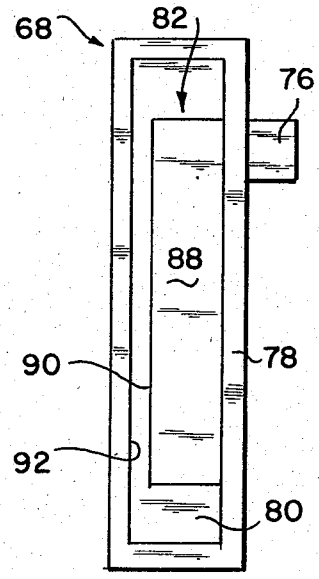
Figure 9:
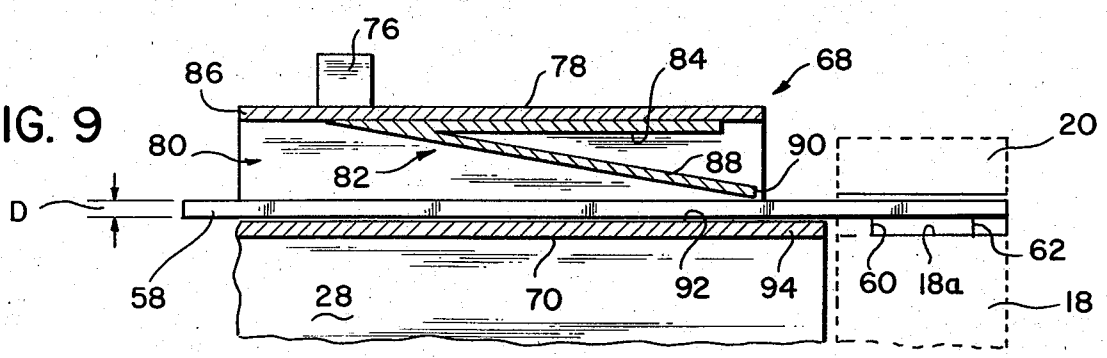

FIG. 4 illustrates the FIG. 3 apparatus together with web 10 in residence in both channel 36 and guide 38. This stage of activity is achieved by threading web 10 into the feed end of chute 34 and guiding an end of the web into slot 38 into registry with web puller or advancer 40, same having projections 42 and 44 which are enterable in perforations 14 (FIG. 1). In the stage of activity in FIG. 4, web 10 has been advanced by puller 40 in measure releasing connector 16-1 therefrom, same being accomplished by initial advance of the web along its longitudinal axis and in such predetermined path defined by chute 34 and subsequent movement of the web at an angle to the predetermined path, i.e., in the direction of guide 38. Connector 16-1 is constrained in its movement, throughout such initial and subsequent web movements, to movement in the predetermined path, same being effected by chute walls 34*a* and 34*b* and floor 34*c*. Upon release in leading part from the web, it will be seen that connector 16-1 confronts advance wall portion 34*a*-1 in such constrained movement. Upstream connectors 16-2 and 16-3 will subsequently be advanced to connector seat 30 by withdrawal of puller 40 from engagement with web 10, movement leftwardly thereof in slot 38*a*, re-engagement with web 10, and subsequent rightward movement of puller 40.

In the embodiment under discussion, released connector 16-1 is advanced from its position illustrated in FIG. 4 fully to registration with stop wall 32 through the agency of pusher 46, illustrated in FIGS. 5 and 6 and shown schematically in FIG. 4 leftwardly of its operative position. As seen in FIGS. 5 and 6, pusher 46 comprises a rod 48 pivotally supporting element 50 about pin 52. Rod 48 is supported for translatory motion by supports 54 and 56. In FIG. 5, element 50 is distended so as to engage the rearward surface of connector 16-1 and impel same to confront stop wall 32 on movement of rod 48. In FIG. 6, element 50 is shown in inoperative state, having been rotated into illustrated position to permit the next connector to be released to pass freely therebelow.

Ribbon cable 58 (FIGS. 4 and 7) is now guided into opening 23 (FIG. 1) of connector 16-1 and into registry above insulation-displacing contacts 60 and 62 of connector 16-1, as shown in FIG. 7. Upper or compression die 64 is now advanced by actuating rod 66 to force cover 20 downwardly, thereby effecting movement of cable 58 onto contacts 60 and 62 to effect electrical connection between the conductors of cable 58 and such contacts.

Referring to FIGS. 8–11, cable guide 68 of the invention is dimensioned for translatory movement on top surface 70 (FIG. 3) of lower die 28 within rails 72 and 74 thereof. An upstanding manually grippable projection 76 is provided on upper surface 78 for this purpose. Cable guide 68 includes a leftward open channel 80 for cable entry and includes an interior spring 82 having an upper expanse 84 secured to guide top wall 86 and a depending portion 88 cantilever-supported by portion 84 and extending to an end 90 elevated above cable guide floor 92 by slightly less than the vertical depth D of cable 58, thereby to dress cable 58 and position same precisely adjacent registration lug 94 of guide 68. The dimensions W and H of lug 94 are selected such that lug 94 registers against interior walls 20*a* and 20*b* (FIG. 1) of cover 20 and extends upwardly above ceiling 18*a* of base 18 correspondingly to the height of contacts 60 and 62 thereabove. With such dimensioning, it will be seen that cable 58 is guided into exacting, non-interfering, overlying registry with contacts 60 and 62, as in FIG. 9.

Figure 12:
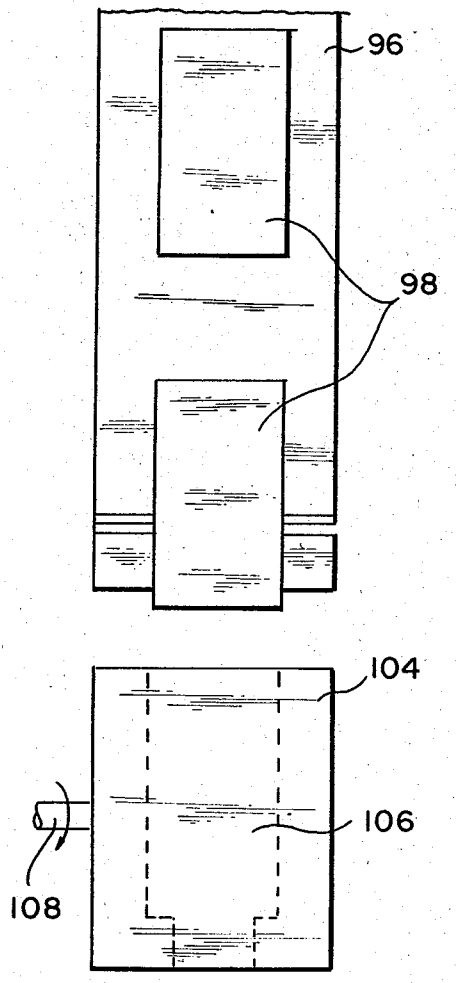
FIG. 12 is a plan view of a web with connector orientation different from that of FIG. 1, shown with an orientation change device.

Turning to FIG. 12, an alternate orientation of connectors on the web is shown wherein web 96 has releasably secured thereto connectors 98. Here, web 96 is in vertical feed disposition in contrast to the horizontal web feed disposition of FIGS. 1–4.

Figure 13:
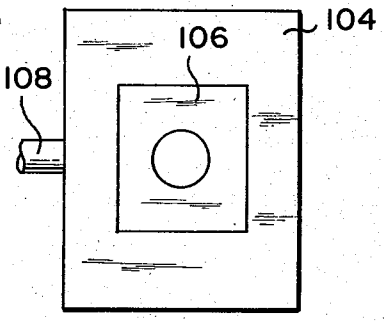
FIG. 13 is a plan view of the orientation change device of FIG. 12.
Figure 14:
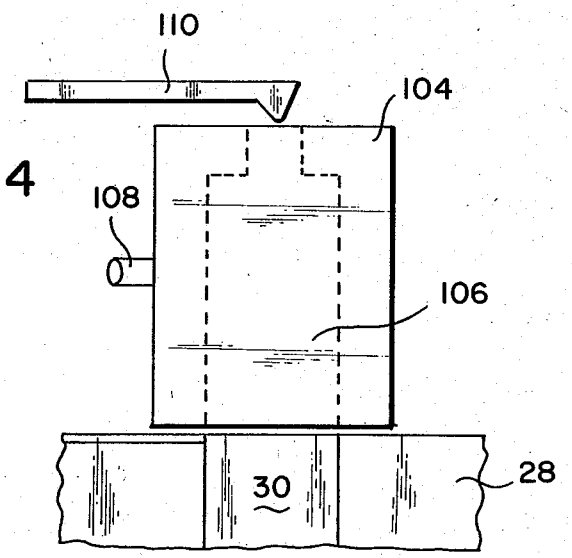
FIG. 14 is a further plan view of the orientation change device of FIG. 12 together with the lower die of FIG. 3.

Web 96 is displaced as shown in FIG. 12 (rearwardly) for connector release, whereupon the released connector is applied to slot 106 of orientator 104, which is rotatable with shaft 108 (FIG. 13). Upon ninety degree rotation of orientator 104, the situation of FIG. 14 applies, i.e., slot 106 is now in alignment with connector seat 30. An air blast is now introduced into slot 106 by nozzle 110, whereupon the released connector in slot 106 is advanced to seat 30.

Figure 15:
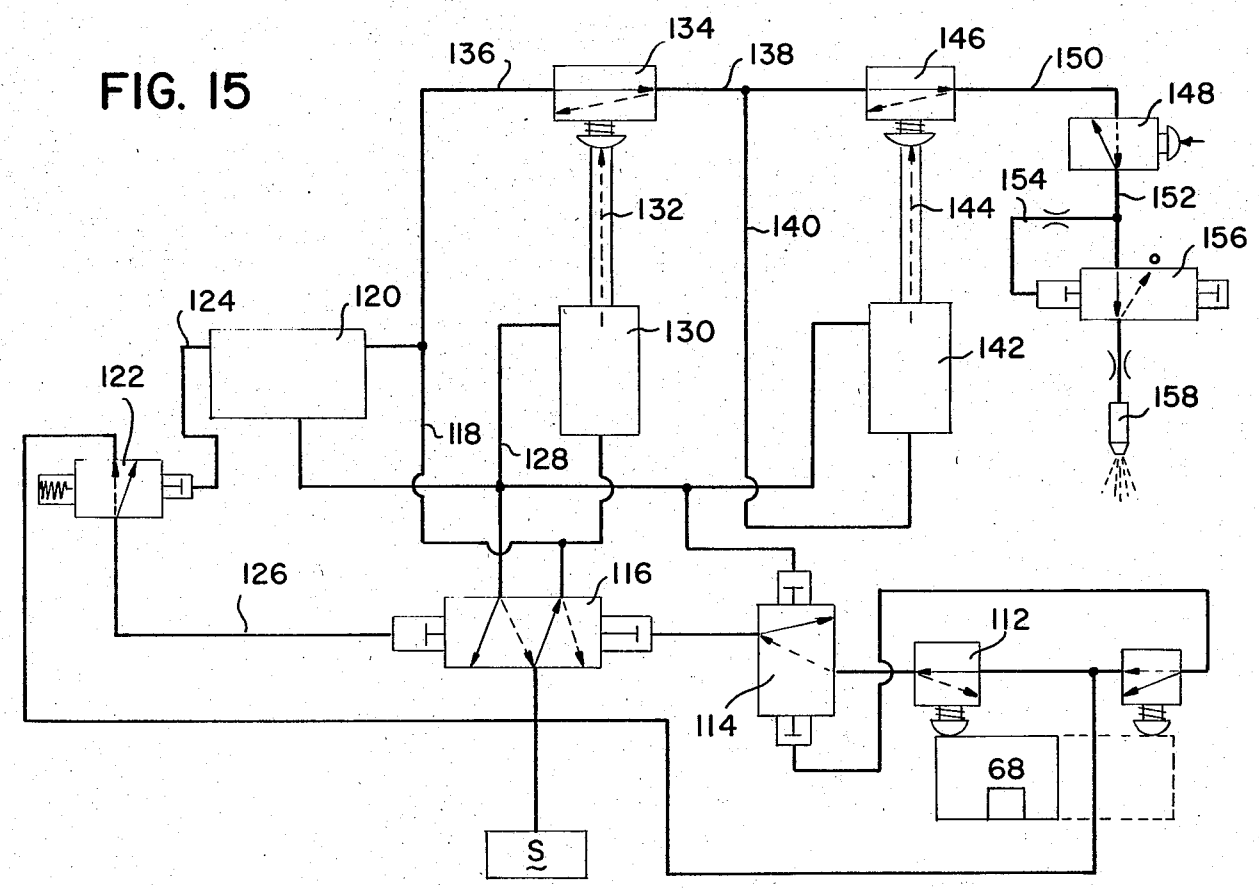
FIG. 15 is a schematic diagram of a pneumatic controller.

FIG. 15 shows a control system for a pneumatic version of apparatus in accordance with the invention. Assuming a connector to be in place for crimping, cable guide 68 is displaced from engagement with the connector to its leftward position in FIG. 15. Pressure from source S now flows through valve 112, the state of which changes upon such movement of guide 68. Pressure is now furnished through valve 114 to displace the spool of valve 116, pressurizing line 118 and activating crimp valve 120. Upon the completion of the crimp cycle, valve 122 is operated by pressure change in line 124 and line 126 reversely displaces the spool of valve 116. This renders line 128 pressurized, causing feed cylinder 130 to advance the web for feeding of the next connector. Upon completion of the stroke of cylinder 130, rod 132 changes the state of valve 134, providing communication between lines 136 and 138.

Line 140, also now pressurized, operates orientation cylinder 142. Upon completion of ninety-degree rotation of orientation device 104, rod 144 changes the state of valve 146. If the previously crimped connector is removed, valve 148 provides communication between lines 150 and 162, thus pressurizing line 154 to displace the spool of valve 156 and issue a blast of pressure through valve 156 to nozzle 158, advancing the next connector into seat 30. At this juncture slide 68 is advanced to register the cable with such connector and, upon withdrawal, the cycle repeats.

While a mass termination station is shown in the form of fixed lower die 28 and fixed upper die 64, same may of course be comprised of fixtures having removable insert dies for accommodating various differently-shaped connectors. Also, mechanical structure, such as for substrate-independent connector movement (pusher 46) and substrate advance (puller 40) may take on various configurations. Further, while two diverse web feed dispositions are shown, various other dispositions will now be apparent. In this connection, orientator 104 may be provided with a family of inserts for slot 106 to accommodate different sized connectors.

Various other changes in practice and modifications to structure may be introduced without departing from the invention. Thus, the particularly disclosed preferred embodiments and practices are intended in an illustrative and not in a limiting sense. The true scope of the invention is set forth in the following claims.

We claim:

1. A system for mass termination of multi-conductor flat cable by insulation-displacement contact connectors, comprising:

(a) means for winding and advancing a reeled substrate having said connectors releasably secured thereto;

(b) means for removing said connectors from said substrate;

(c) die means for individually seating such removed connectors and for forcing conductors of said cable into electrical engagement with the contacts of such removed connectors; and (d) cable guide means for receiving said cable and entering into said seated connectors for guiding said cable into registry with said contacts thereof.

2. The system claimed in claim 1 wherein said cable guide means is supported for movement from such entrance thereof into said seated connectors into an inoperative position.

3. The system claimed in claim 2 further including means (e) responsive to residence of said cable guide means in said inoperative position for operating said means (c).

4. The system claimed in claim 3 further including means (f) for sensing the completion of such operation of said means (c) and thereupon operating said means (b).

5. The system claimed in claim 1 further including means for receiving such removed connectors, changing the orientation thereof, and delivering same to said means (c).

6. The system claimed in claim 4 further including means (g) for receiving such removed connectors, changing the orientation thereof, and delivering same to said means (c), and means (h) for sensing the completion of operation of said means (g).

* * * * *